US006014537A

United States Patent [19]

Van Aken et al.

[11] Patent Number: 6,014,537

[45] Date of Patent: Jan. 11, 2000

[54] METHOD OF DEVELOPING AN IMAGE IN AN IMAGE FORMING APPARATUS

[75] Inventors: Luc Karel Maria Van Aken, Hasselt; Robert Frans Louisa Janssens, Geel, both of Belgium

[73] Assignee: Xeikon NV, Mortsel, Belgium

[21] Appl. No.: 09/295,442

[22] Filed: Apr. 21, 1999

[30] Foreign Application Priority Data

May 11, 1998 [EP] European Pat. Off. ..... 98303674

[51] Int. Cl.[7] ..... G03G 15/09; G03G 13/22

[52] U.S. Cl. ..... 399/271; 430/122

[58] Field of Search ..... 399/240, 241, 399/291, 293, 295, 270, 271, 285; 430/122

[56] References Cited

U.S. PATENT DOCUMENTS

| | | | |
|---|---|---|---|
| 4,844,008 | 7/1989 | Sakemi et al. | 399/270 |
| 5,185,496 | 2/1993 | Nishimura et al. | 399/270 X |
| 5,227,270 | 7/1993 | Scheueret et al. . | |
| 5,314,774 | 5/1994 | Camis . | |
| 5,409,791 | 4/1995 | Kaukeinen et al. | 430/122 X |
| 5,631,679 | 5/1997 | Kagayama | 399/291 X |
| 5,701,553 | 12/1997 | Endo et al. | 399/291 X |

FOREIGN PATENT DOCUMENTS 0 432 998 A2 6/1991 European Pat. Off. .

OTHER PUBLICATIONS

Kobayashi et al., "A Mechanism for Resolution Decrease in Organic Photoconductor", Journal of Imaging Science and Technology, vol. 39. No. 6, Nov./Dec. 1995, pp. 485–489.

Nguyen et al., "Technology Trends in the Development of Organic Photoconductors for New Applications", Journal of Imaging Technology 15; pp. 158–163, 1989.

Ishikawa et al., "Organic Photoconductors for Electrophotography", Reprographic Products Group, pp. 82–97.

Weiss et al., "Photofatigue of Organic Photoreceptors with Triarylamine–Based Charge Transport Layers", Journal of Imaging Science and Technology, vol. 39, No. 5, Sep./Oct. 1995, pp. 425–428.

Baumann et al., "Organic Semiconductors Used in Electrophotography", IS&T Reporter, vol. 8, No. 2, Jun. 1993.

*Primary Examiner*—Susan S. Y. Lee
*Attorney, Agent, or Firm*—Larson & Taylor

[57] ABSTRACT

An image forming apparatus is used, in which an electrostatic image formed on a moving image forming belt is developed by AC development. Where the image forming belt moves at a speed of $v_p$ mm/s, the cleaning potential is $V_{cl}$ volts, and the AC bias frequency is f kHz, the function Z satisfies the following equation:

$$Z = \frac{V_{cl}^2 \times f}{v_p^2} > 0.65.$$

Images substantially free of background development are thereby obtained.

6 Claims, 3 Drawing Sheets

METHOD OF DEVELOPING AN IMAGE IN AN IMAGE FORMING APPARATUS

FIELD OF THE INVENTION

The present invention relates to a method of using an image forming apparatus, such as a copier, printer or the like, in which an electrostatic image is formed on an image forming member, from which it is subsequently transferred, directly or indirectly to a substrate.

BACKGROUND TO THE INVENTION

In a typical image forming apparatus, an electrostatic image is formed on an image forming member, which may for example be the photoconductive surface of a rotating drum or the photoconductive surface of a moving belt. The electrostatic image is, for example, formed by charging the photoconductive surface to a first potential $V_0$, known as the "dark" potential, and then image-wise exposing the charged photoconductor surface to dissipate the charge on image areas. The electrostatic image is brought into the vicinity of a developing device, which is supplied with developer, typically a mixture of a particulate toner and magnetic carrier particles.

It is common practice to apply the toner-carrier mixture to the surface carrying the electrostatic charge image by means of a developing unit wherein toner and magnetizable carrier particles are mixed and a layer of the toner-carrier mixture, referred to herein as "developer", is picked up by an applicator such as a rotating sleeve or drum having magnets inside, forming a so-called magnetic brush on a "magnetic roller".

In one type of development unit toner particles are mixed with larger magnetizable carrier particles, to which the toner particles adhere by electrostatic attraction force. The electrostatic charge of the toner and carrier particles is obtained triboelectrically by agitation. The charge sign of the toner particles is opposite to the charge sign of the carrier particles.

On rotating the magnetic roller, the toner particles still adhering to the magnetically attracted carrier particles are brought into a developing zone wherein the toner particles are separated from the carrier particles by the electrostatic attraction forces of the electrostatic latent image to be developed and transfer to the latent electrostatic charge image. The sign of the toner particles, compared with the sign of the charge on the image forming member, determines whether the development is a "direct" or "reversed" development. If the toner and the image forming member have opposite signs, the development is direct; toner particles will be attracted to the charged areas of the image forming member. If the toner and the image forming member have the same sign, the development is "reverse"; toner particles will be attracted to the discharged areas of the image forming member.

A DC developing bias potential $V_{DC}$ of suitable value is applied between the magnetic brush and the back electrode of the image forming member. The sign of the DC bias potential is the same as that of the image forming member. The value of the DC bias potential is typically between the value of the potential of the image areas and that of the non-image areas.

The term "cleaning potential" is defined as the absolute value of the difference between the potential of the non-image areas and the DC bias potential. The main effect of this cleaning potential is to establish an electric field between the magnetic roller and the image forming member at the non-image areas which repulses the toner particles away from the image forming member back to the magnetic brush.

The term "development potential" is defined as the absolute value of the difference between the potential of the image areas and the DC bias potential. The main effect of this development potential is to establish an electric field between the magnetic roller and the image forming member at the image areas which attracts the toner particles to the image areas.

Toner particles are attracted to the electrostatic image on the image forming member to thereby form a toner image. Subsequently the image forming member, carrying the toner image, comes into contact with a substrate, for example paper in sheet or web form, to which the toner image is transferred. Alternatively, the transfer of the toner image from the image carrying member to the substrate may be by way of one or more intermediate transfer members.

It is known to superimpose an AC voltage over the DC bias between the developer carrying member and the back electrode of the image forming surface.

This AC development method has a number of advantages. Higher toner amounts can be transferred towards the photoconductor during AC development than can be achieved with DC-only development, resulting in higher print densities on the image. Using an AC electric field during development reduces the development time constant considerably, resulting in a better development of image areas containing a sharp transition from a high density to a low density or vice versa. The result is an image with sharper well-defined image edges. The image density developed with AC development is less sensitive to variations in distance of the photoconductor to the magnetic roller, and less sensitive to variations in developer supply on the magnetic roller. Furthermore, AC development leads to images with less blow-off and a better homogeneity of line widths.

An example of an image forming apparatus using AC development is shown in U.S. Pat. No. 5,314,774 (Hewlett Packard) which describes a method and apparatus for developing and printing color images on a moving photoconductive belt. A number of developing devices are spaced from the belt and are AC and DC biased to project toner onto the belt. The composite color image thereby formed on the belt is then transferred to an intermediate belt and from there to a final substrate. A relationship is disclosed defining the motion of toner particles in the air gap between the developer carrying member in the developing device, and the belt in terms of the size of the toner particles, the viscosity of the air gap, the charge on the toner and the DC and AC electrostatic fields.

European patent specification EP 432998-A (Xerox Corporation) describes a scavenge-less/non-interactive electrostatographic development system in which a powder cloud is generated between a developer donor roller and a set of wires mounted between the donor roller and an image forming belt. For use in highlight color imaging, the system uses the combination of an AC voltage on the donor roller with an AC voltage between the toner cloud forming wires and the donor roller to control the developability of lines and the degree of interaction between the toner and a photoconductive belt.

U.S. Pat. No. 5,409,791 (Eastman Kodak Company) describes an image forming method in which an electrostatic image on an photoconductive belt already carrying a loose dry first toner image is toned with a second toner, for example having a different color. The toning is accomplished by a developer having a high coercivity permanently magnetized carrier and toner which is moved through a development zone by a rapidly rotating core inside a sleeve on which the developer moves. Scavenging of the first toner image is prevented by separating the sleeve from the photoconductive belt sufficiently that the crests of the developer do not touch the photoconductive belt during the toning process. An alternating electrical field is applied between the sleeve and the photoconductive belt to enhance development.

A problem which arises with AC development onto photoconductor belts, especially where the photoconductor is an organic photoconductor, is background development, especially when AC development is used in combination with a high belt speed. It appears that the higher surface roughness which is typical of belt photoconductors, as compared with drum photoconductors, contributes to this problem.

It is an object of the present invention to provide a method of AC development, in which the image is substantially free of background.

SUMMARY OF THE INVENTION

We have discovered that this objective and other useful benefits can be achieved where the dark potential, the DC bias potential, the AC bias frequency, and the belt speed satisfy a specified relationship.

Thus according to the invention, there is provided a method of using an image forming apparatus, in which an electrostatic image formed on a moving image forming belt is developed by AC development, wherein the function Z satisfies the following equation:

$$Z = \frac{V_{cl}^2 \times f}{v_p^2} > 0.65$$

where $V_{cl}$ is the cleaning potential in volts, f is the AC bias frequency in kHz, and $v_p$ is the speed of the image forming belt in mm/s.

Preferably, Z is at least 0.8. We have calculated that given the data provided in U.S. Pat. No. 5,409,791 referred to above, the value of the function Z lies between about 0.03 and 0.3. Insufficient data is provided in EP 432998 (Xerox Corporation) referred to above to derive a value for the function Z.

The present invention will usually involve forming a layer of developer on a developer carrying member behind which a magnetic field generating device is disposed. The developer is carried to a developing position where the developing carrying member and the image bearing belt are opposed. It is an important aspect of the present invention that the developer layer contacts the image forming belt in the developing position. This is in contrast to the arrangement described in U.S. Pat. No. 5,409,791, where the developer sleeve is separated from the photoconductive belt sufficiently to prevent scavenging of the first toner image. In the present invention, the image forming belt does not already carry a toned image when it arrives at the developing position, so that the problem of scavenging described in U.S. Pat. No. 5,409,791 cannot arise. In contrast to the method described in U.S. Pat. No. 5,409,791, the "contact" development process of the present invention is able to lead to better development, in particular to better image quality (reduced edge effects, fewer problems with high-to-low and low-to-high image density transitions, better grey level rendition and a lower image noise level) and fewer problems with carrier loss.

The developer which is used in the method according to the invention preferably comprises toner particles and non-permanently magnetized magnetic carrier particles. Permanently magnetized carrier particles are less preferred since they stick together and developers containing such particles are difficult to mix and to charge, it is difficult to mix newly added toner with such carrier particles and the developers exhibit very bad flow characteristics. As a consequence developing units, such as described in U.S. Pat. No. 5,409,791 referred to above, which use developers containing permanently magnetized carrier particles consume a lot of energy.

The toner particles preferably contain a mixture of a resin, a dye or pigment of the appropriate color and normally a charge-controlling compound giving triboelectric charge to the toner. In dual-component developers which are normally used, carrier particles are also present for charging the toner particles by frictional contact therewith. The carrier particles may be made of a magnetizable material, such as iron or iron oxide. Developing technologies other than magnetic brush development, such as mono-component developers, can be used.

Dry-development toners essentially comprise a thermoplastic binder consisting of a thermoplastic resin or mixture of resins including coloring matter, e.g. carbon black or coloring material such as finely dispersed pigments or dyes.

The mean diameter of dry toner particles for use in magnetic brush development is conventionally about 10 $\mu$m (ref. "Principles of Non Impact Printing" by Jerome L. Johnson—Palatino Press Irvine Calif., 92715 U.S.A. (1986), p. 64–85). For high resolution development, the mean diameter may be from 1 to 5 $\mu$m (see e.g. British patent specification GB-A-2180948 and International patent specification WO-A-91/00548). However, in the present invention, the toner particle size may be from 5 to 15 $\mu$m, most preferably between 7 and 12 $\mu$m.

The toner particles contain in the resinous binder one or more colorants (dissolved dye or dispersed pigment) which may be white or black or has a color of the visible spectrum, not excluding however the presence of infra-red or ultraviolet absorbing substances.

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyi acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. The volume resistivity of the resins is preferably at least $10^{13}$ Ω-cm.

We prefer to use toners having a composition comprising a thermoplastic binder together with from 10% to 50% by weight of a pigment, based on the weight of the toner composition. The use of toner compositions having a higher level of pigment therein enables images with a higher density to be printed. Alternatively, for the same image density, smaller toner particles can then be used.

The charge on the toner particles generated usually by an agitator in the developing unit, preferably lies between 5 and 25 $\mu$C/g, most preferably from 10 to 20 $\mu$C/g.

The magnetic brush, from which toner particles are removed during each revolution, to be taken up by the developed electrostatic charge image, has to be supplied with fresh toner-carrier mixture. This is normally done by an agitator projecting or scooping up toner-carrier mixture onto the magnetic roller from a housing for holding the developer. The partly exhausted developer is returned to the bulk of developer contained in the housing and has to be thoroughly mixed timely with freshly added toner to keep the toner-carrier weight ratio within acceptable limits for obtaining consistent development results.

Preferably, the applicator comprises a rotatable developing sleeve having magnets located therein for attracting developer onto the sleeve.

The cleaning potential $V_{cl}$ preferably lies between 20 and 250 volts, most preferably between 100 and 150 volts. If the cleaning potential is too high, carrier particles may be attracted to the image forming member resulting in carrier loss and/or breakdown. If the cleaning potential is too low, the non-image areas will be soiled by background development.

The development potential $V_{DEV}$ preferably lies between 50 and 500 volts, most preferably between 150 and 350 volts. If the development potential is too high, too many toner particles will be developed resulting in a too high image density and in excessive toner consumption. If the development potential is too low, insufficient development takes place.

The absolute value of the dark potential $V_0$ preferably lies between 200 and 800 volts, most preferably between 300 and 500 volts. If the absolute value of the dark potential is too high, charge breakdown may occur. If the absolute value of the dark potential is too low, the development and cleaning potentials may be insufficient.

The preferable ranges for the DC bias potential $V_{DC}$ and the potential after exposure, $V_e$, are defined by the preferred ranges for the cleaning potential $V_{cl}$, the development potential $V_{DEV}$ and the dark potential $V_0$, since the following relations hold:

$$\text{for reverse development} V_{DEV} = |V_{DC} - V_e|$$

$$V_{Cl} = |V_0 - V_{DC}|$$

$$\text{for direct development } V_{DEV} = |V_0 - V_{DC}|$$

$$V_{Cl} = |V_{DC} - V_e|$$

The AC bias frequency f preferably lies between 1 and 8 kHz, most preferably between 2 and 6 kHz. If the AC bias frequency is too high, high bias currents are needed. Moreover, the advantages of AC development will be lost because the toner particles stop being influenced by the AC electric field because acceleration forces acting on the toner particles will become too high. If the AC bias frequency is too low, the toner particles will be able to follow each individual AC bias pulsation resulting in a rippling effect in the developed image.

The AC peak-to-peak voltage $V_{AC}$ preferably lies between 500 and 3000 volts, most preferably between 1000 and 2000 volts peak-to-peak. If the AC peak-to-peak voltage is too high, high bias currents are needed, charge breakdown may occur and carrier loss may result. If the AC peak-to-peak voltage is too low, the effect of AC bias development will be too small and the corresponding advantages will not be attained.

The speed of the image forming belt vp preferably lies between 50 and 500, most preferably between 125 and 300 mm/s. If the belt speed is too high, development will be insufficient and more than one magnetic roller and/or a magnetic roller with a large diameter will have to be used. If the belt speed is too slow, the engine will have an undesirable low throughput.

The image forming belt may be in the form of a charge carrying belt onto which charge images are deposited by ion-deposition or, more preferably, in the form of a photoconductive belt. The photoconductive belt may comprise a base layer of a polymer material of 60 to 200 $\mu$m thickness covered with a thin conductive layer as a back electrode (preferably 0.05 to 1 $\mu$m thickness). If the overall thickness of the belt is too high, the belt may be insufficiently flexible to closely follow the circumference of guide rollers and may become subject to deformation on standing. One or more layers of an inorganic photoconductor, or more preferably an organic photoconductor, are positioned on top of the conductive layer with a total thickness of, for example, from 10 to 20 $\mu$m. To make contact with the back electrode, the belt has at least one strip of conductive material positioned beyond the image area and extending through the photoconductive layer. Conductive grounding brushes may be provided to contact this conductive strip.

The apparatus may be in the form of a multi-color duplex printer of the type comprising two image forming stations positioned one on either side of a substrate path. Sheets to be printed, preferably removed from a stack located within a housing of the apparatus, are fed along the path into operational positions relative to the two image-forming stations where toner images are transferred thereto and then to a fuser station where the toner images are fixed.

The removed sheet may be fed through an alignment station which ensures the longitudinal and lateral alignment of the sheet, prior to its start from said station under the control of the imaging system. As the sheet leaves the alignment station, it preferably follows a straight horizontal path through the printer. The speed of the sheet, along the path, may be determined by a driven pressure roller pair.

A buffer station may be positioned between the second image forming station and the fuser station, allowing the speed of the sheet to decrease to enable the speed of fuser to be lower than the speed of image formation.

Each image forming station comprises an endless image forming belt guided, for example, over a plurality of idler guide rollers to follow a path to advance successive portions of the image forming surface sequentially through various processing stations disposed along the path of movement thereof. The image forming surface of the belt is ideally positioned at the outside of its loop. Drive means are provided for driving the belt, preferably at a uniform speed and for controlling its lateral position. The drive means for the belt may comprise one or more drive rollers, driven by a controlled drive motor, to ensure a constant drive speed.

In a preferred embodiment, a portion of photoconductive belt passes through a charging station which charges the belt to a substantially uniform potential. Next, the belt passes to an exposure station which exposes the photoconductive belt to successively record four latent color separation images. The latent images are developed for example with magenta, cyan, yellow and black developer material, respectively. These developed images are transferred to the print sheet in superimposed registration with one another to form a multicolor image on the sheet. After an electrostatic latent image has been recorded on the image forming belt, the belt advances this image to a development station which includes four individual developer units.

Each developer unit may be of the type generally referred to in the art as "magnetic brush development units". Typically, a magnetic brush development system employs a magnetizable developer material including magnetic carrier granules having toner particles adhering triboelectrically thereto. The developer material is continuously brought through a directional flux field to form a brush of developer material. The developer particles are continuously moving so as to provide the brush consistently with fresh developer material. Development is achieved by bringing the brush of developer material into contact with the image forming surface. The developer units respectively apply toner particles of a specific color which corresponds to the compliment of the specific color-separated electrostatic latent image recorded on the image forming surface. The color of each of the toner particles is adapted to absorb light within a preselected spectral region of the electromagnetic wave spectrum. Each of the developer units is moved into and out of an operative position. In the operative position, the magnetic brush is closely adjacent to the image forming belt, whereas in the non-operative position, the magnetic brush is spaced therefrom. During development of each electrostatic latent image only one developer unit is in the operative position, the remaining developer units being in their non-operative position. This ensures that each electrostatic latent image is developed with toner particles of the appropriate color without inter-mingling.

Each development unit may include a magnetic roller. The moving image forming belt moves close to, but not in contact with, the magnetic roller. Spacing means, such as a fixed sliding backing shoe, may be provided to determine a constant distance between the image forming surface of the belt and the magnetic roller. The controlled DC+AC potential is applied between the magnetic roller and the back electrode of the image forming surface of the belt. The development unit may include or be associated with a control device for setting the cleaning potential $V_{cl}$ within a desired range and setting the AC frequency to ensure that the value of the function Z exceeds 0.65.

After their development, the images are moved to toner image transfer stations where they are transferred on a sheet of support material. At each transfer station, the sheet follows the path into contact with the image forming belt. The sheet is advanced in synchronism with the movement of the belt. After transfer of the four toner images, the belt is cleaned in a cleaning station. Thereafter, a lamp illuminates the belt to remove any residual charge remaining thereon prior to the start of the next cycle.

The timing of exposure of the four distinct images, the relative position of these images on the image forming belt and the lengths of the path of this belt between the successive transfer stations are such that as a sheet follows the path through these stations, the partly simultaneous transfer of the distinct toner images to the paper sheet is such that a perfect registering of these images is obtained.

The buffer station may be provided with an endless transport belt which transports the sheet bearing the color images to the fuser station. The fuser station operates to melt the toner particles transferred to the sheets in order to affix them. This operation requires a certain minimum time since the temperature of the fuser is subject to an upper limit which must not be exceeded. Otherwise the lifetime of the fuser roller becomes unsatisfactory. For this reason, the speed of the fuser station may be limited. It is advantageous to use a high speed of image formation and image transfer, since the four color separations of each color image are recorded by exposure station in succession, which means that the recording time of one color image amounts to at least four times the recording time of one color component. Therefore, a relatively high speed of the image forming belt is required, and thus of the synchronously moving sheets, as compared with a maximum usable traveling speed through the fuser station. Furthermore, it may be desirable to adjust the fusing speed independently of the image processing speed, i.e. the belt speed, for obtaining optimum results. It should be noted that the image processing speed in the imaging stations is preferably constant. The length of the buffer station should be sufficient for receiving the largest sheet size to be processed in the apparatus. The buffer station operates initially at the speed of the image forming belts of image forming stations. The speed of this station is reduced to the processing speed of the fuser station as the trailing edge of the sheet leaves the second image forming station.

The fusing station can be of known construction, and can be arranged for radiation or flash fusing, for fusing by convection and/or by pressure, etc. Hot roller fusing is preferred.

One image-forming station need not necessarily operate with one exposure station but may include more than one exposure station, each such station co-operating with several developer units.

The printing apparatus is not limited to color reproduction but may also be a black-and-white printer.

The printing apparatus is not limited to duplex printing but may also be a single-side printer.

BRIEF DESCRIPTION OF THE DRAWING

The invention will be described in further detail, purely by way of example, with reference to the accompanying drawings, in which.

DETAILED DESCRIPTION

Figure 1:
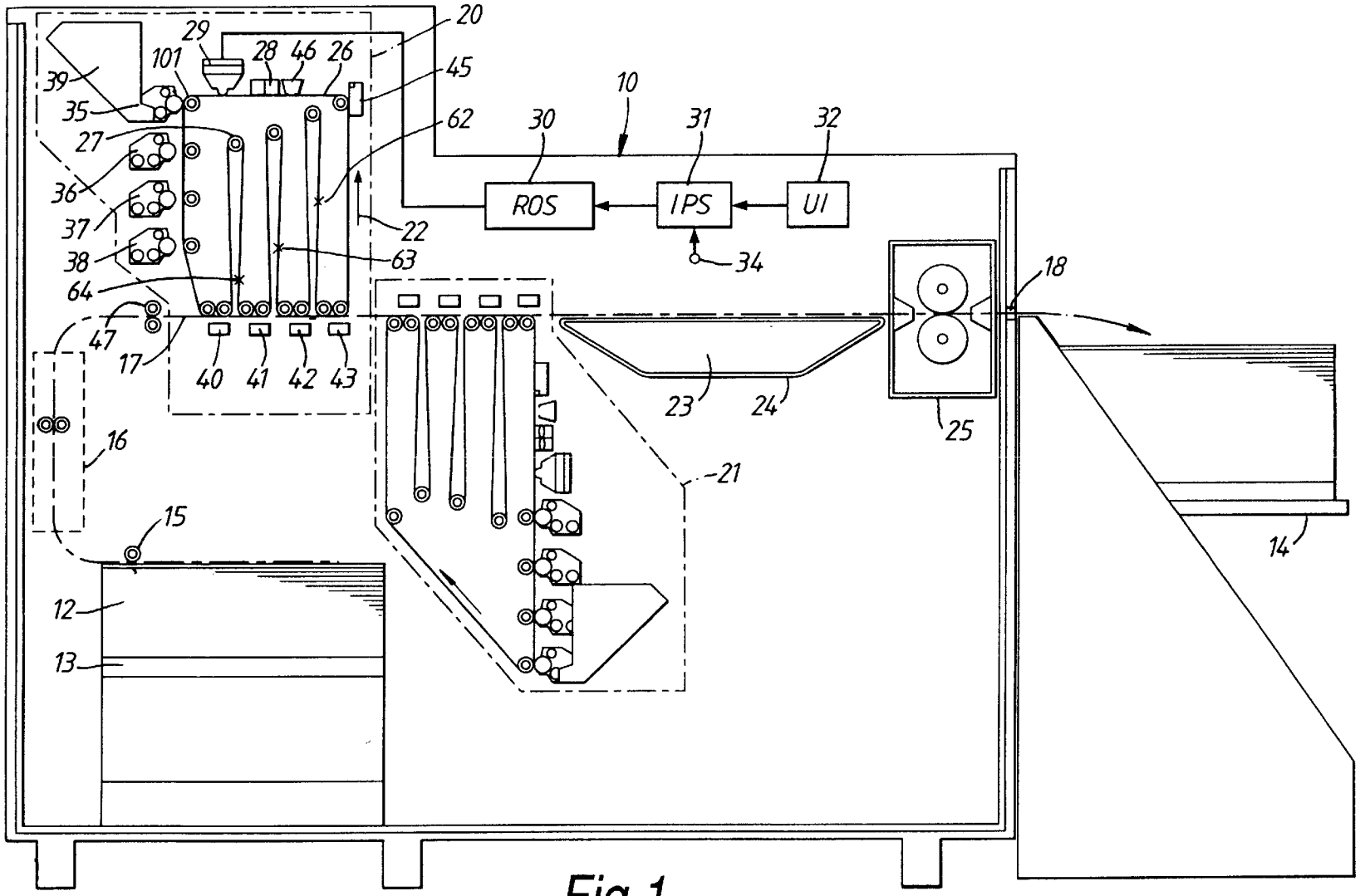
FIG. 1 is a diagrammatic representation of one embodiment of an electrophotographic duplex color printer.

FIG. 1 shows a diagrammatic representation of one embodiment of an electrophotographic duplex color printer.

The printer comprises a light-tight housing 10 which has at its inside a stack 12 of sheets to be printed and loaded on a platform 13. The height of this platform 13 is adjusted in accordance with the size of the stack 12. At its output the printer has a platform 14 onto which the printed sheets are received.

A sheet to be printed is removed from stack 12 by a dispensing mechanism 15 of known construction for removing the top sheet from stack 12.

The removed sheet is fed through an alignment station 16 which ensures the longitudinal and lateral alignment of the sheet, prior to its start from said station under the control of the imaging system. As the sheet leaves the alignment station, it follows a straight horizontal path 17 up to output section 18 of the printer. The speed of the sheet, upon entering said path, is determined by driven pressure roller pair 47, driven by a stepper motor, the frequency of which is adjustable with an accuracy of a piezo crystal (i.e. better than $10^{-6}$).

A number of processing stations are located along the path 17. A first image-forming station 20 indicated in a dash-and-dot line is provided for applying a multi-color image to the obverse side of the sheet and is followed by a second station 21 for applying a multi-color image to the reverse sheet side. A buffer station 23 then follows, with an endless transport belt 24 for transporting the sheet to a fuser station 25 while allowing the speed of the sheet to decrease because the speed of fuser 25 is lower than the speed of image formation.

Both image forming stations 20 and 21 being similar to each other, only station 20 will be described in more detail hereinafter.

An endless photoconductor belt 26 is guided over a plurality of idler rollers 27 to follow a path in the direction of arrow 22 to advance successive portions of the photoconductive surface sequentially through the various processing stations disposed about the path of movement thereof.

The photoconductor belt 26 is driven by a drive rollers 101, driven with a DC-motor with encoder feedback, the motor being coupled to the drive roller 101 over a two-step reduction with a total reduction of 1/25. The driving speed is kept constant by measuring the belt revolution time and adjusting the speed so that the belt revolution time is constant. In this manner a belt speed accuracy of $10^{-4}$ can be achieved.

Means (not shown) are provided controlling the lateral position of the photoconductive belt 26.

The photoconductive belt may comprise a base layer of polyethyleneterephthalate of 100 $\mu$m thickness covered with a thin layer of aluminum as a back electrode (less than 0.5 $\mu$m thickness). The organic photoconductor (OPC) layer is on top of the aluminum layer and is from 15 $\mu$m in thickness. To make contact with the aluminum back electrode, the photoconductor has two strips of carbon/polymer mixture, with a width of 10 mm, positioned beyond the image area and extending through the OPC layer. Conductive grounding brushes (not shown) contact these carbon strips. The belt is arranged such that the photoconductive layer is positioned on the outside of the belt loop.

Initially, a portion of photoconductive belt 26 passes through charging station 28. At the charging station, a corona-generating device electrostatically charges the belt to a relatively high, substantially uniform potential, the dark potential $V_0$. Next, the belt passes to an exposure station 29. The exposure station includes a raster output scanner (ROS) 30 including a laser with a rotating polygonal mirror block which creates the output printing image by laying out the image in a series of horizontal scan lines. Exposure station 29 will expose the photoconductive belt to successively record four latent color separation images. The latent images are developed for example with magenta, cyan, yellow and black developer material, respectively. These developed images are transferred to the print sheet in superimposed registration with one another to form a multicolor image on the sheet. The ROS receives its input signal from an image processing system (IPS) 31. This system is an electronic control device which prepares and manages the data inflow to the scanner 30. A user interface (UI) 32 is in communication with the IPS and enables the operator to control various operator-adjustable functions. IPS 31 receives its signal from input 34. This input can be the output of a raster input scanner (RIS), in which case the apparatus is a so-called intelligent copier. In such case, the apparatus contains document illumination lamps, optics, a mechanical scanning drive, and a charge-coupled device. The RIS captures the entire original document and converts it to a series of raster scan lines and measures a set of primary color densities, i.e. red, green and blue densities at each point of the original document. However, input 34 can as well receive an image signal resulting from an operator operating an image processing station.

After an electrostatic latent image has been recorded on the photoconductive belt 26, the belt 26 advances this image to the development station. This station includes four individual developer units 35, 36, 37 and 38.

The developer units are of a type generally referred to in the art as "magnetic brush development units". Developer units 35, 36 and 37, respectively, apply toner particles of a specific color which corresponds to the compliment of the specific color-separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 26, while the green areas will be reduced to a voltage level ineffective for development. The charged areas are then made visible by having developer unit 35 apply green absorbing (magenta) toner particles onto the electrostatic latent image recorded on photoconductive belt 26. Similarly, a blue separation is developed by developer unit 36 with blue absorbing (yellow) toner particles, while the red separation is developed by developer unit 37 with red absorbing (cyan) toner particles. Developer unit 38 contains black toner particles and may be used to develop the electrostatic latent image formed from black information or text, or to supplement the color developments. Each of the developer units is moved into and out of an operative position. In the operative position, the magnetic brush is closely adjacent to the photoconductive belt, whereas in the non-operative position, the magnetic brush is spaced therefrom. During development of each electrostatic latent image only one developer unit is in the operative position, the remaining developer units being in their non-operative one. This ensures that each electrostatic latent image is developed with toner particles of the appropriate color without inter-mingling. In FIG. 1, developer unit 35 is shown in its operative position. Finally, each unit comprises a toner hopper, such as hopper 39 shown for unit 35, for supplying fresh toner to the developer which becomes progressively depleted by the development of the electrostatic charge images.

Figure 2:
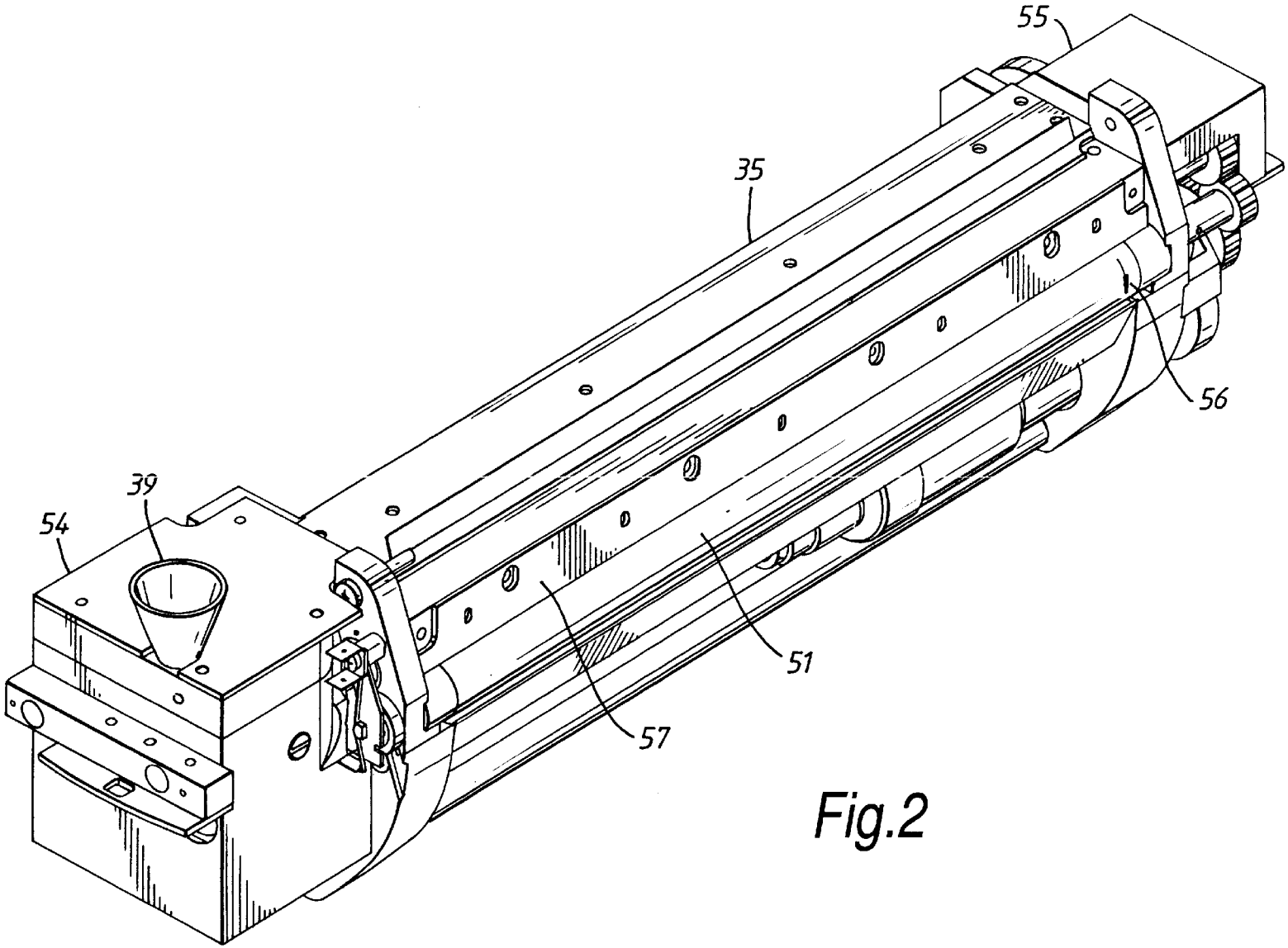
FIG. 2 is an isometric view of one embodiment of a development unit of the printer shown in FIG. 1.

Referring to FIG. 2, there is shown one of the developing units, namely unit 35 which on its front side has a magnetic roller 51 consisting of a non-ferromagnetic sleeve rotatable around a non-rotating magnetic core and slightly protruding from the unit for bringing a layer of developer adhering in the form of a brush to its outer surface into contact with the photoconductive surface of the belt 26. The developing unit 35 is supplied with magnetizable development material including non-permanently magnetized magnetic carrier granules having toner particles adhering triboelectrically thereto. The developer material is continually brought through a directional flux field to form a brush of developer material. The developer materials are continuously moving so as to provide the brush consistently with developer material. The left hand part of FIG. 2 shows a mixer arrangement 54 with a toner hopper 39, whereas the right hand part is the driving mechanism 55 with inter-engaging gears for the driving of the rotatable rollers of the unit 35. Magnetic roller 51 rotates in the direction of the arrow 56 and the thickness of the layer of developer supplied to its surface is metered by an adjustable doctor blade 57. The representation of the toner hopper 39 is diagrammatic only, and it will be understood that in practice the toner addition system will comprise a toner cartridge or bottle suitably and removably connected to the unit, and a metering system for feeding controlled amounts of toner to the unit 35.

Figure 3:
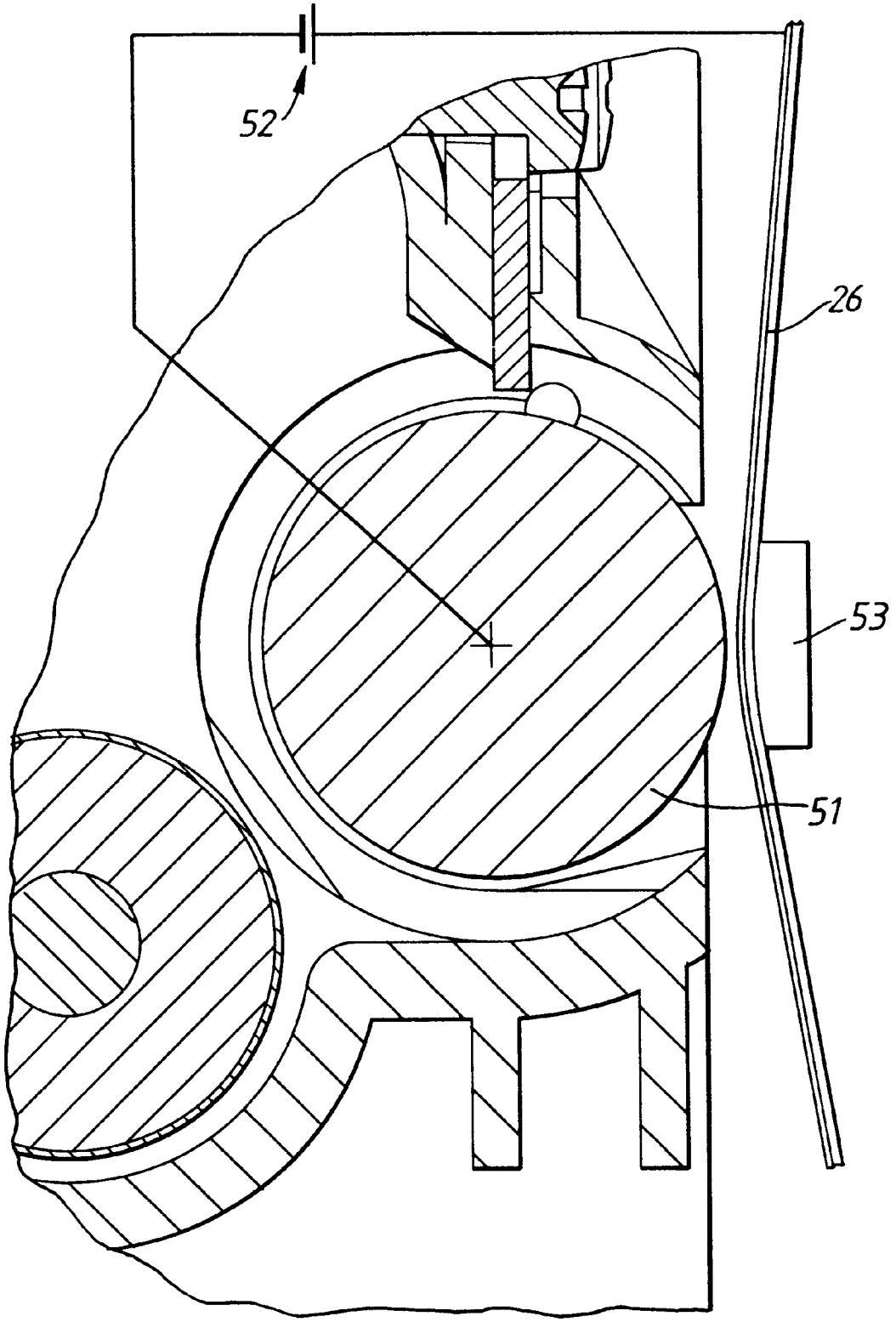
FIG. 3 shows detail from part of the development unit shown in FIG. 2.

Part of the development unit 35 is shown in cross-section in more detail in FIG. 3. As will be seen in this Figure, the development unit includes a magnetic roller 51. The moving photoconductive belt 26, moves close to, but not in contact with, the magnetic roller 51. The distance between the photoconductive surface of the belt 26 and the magnetic roller 51 is constant and is determined by a fixed sliding backing shoe 53. A controlled DC+AC potential is applied between the magnetic roller and the back electrode of the photoconductive surface of the belt 26 via contact brushes (not shown) by a control device generally represented at 52.

After their development, the toner images are moved to toner image transfer stations 40, 41, 42 and 43 where they are transferred on a sheet of support material, such as plain paper or a transparent film. At a transfer station, a sheet follows the rectilinear path 17 into contact with photoconductive belt 26. The sheet is advanced in synchronism with the movement of the belt. After transfer of the four toner images, the belt following an upward course is cleaned in a cleaning station 45 where a rotatable fibrous brush or the like is maintained in contact with the photoconductive belt 26 to remove residual toner particles remaining after the transfer operation. Thereafter, lamp 46 illuminates the belt to remove any residual charge remaining thereon prior to the start of the next cycle.

The operation of the printer described hereinbefore is as follows.

The magenta latent image being exposed by station 29 on photoconductive belt 26, this image is progressively developed by station 35 being in its operative position as the belt moves therethrough. Upon completion of the exposure of the magenta image, the yellow image becomes exposed. During the yellow exposure, the developed magenta image is transported past inactive stations 36, 37 and 38 while toner transfer stations 40 to 43 are also still inoperative.

As the development of the magenta latent image is finished, magenta development station 35 is withdrawn to its inoperative position and after the trailing edge of the magenta image has passed yellow development station 36, this station is put into the operative position to start the development of the yellow latent image. While the latter portion of the yellow latent image is being developed, the exposure of the cyan latent image at 29 starts already.

The described processes of image-wise exposure and color development continue until the four color separation images have been formed in successive spaced relationship on the photoconductive belt.

A sheet which has been taken from stack 12 and kept in readiness in aligner 16, is then advanced and reaches toner transfer station 40 where at that moment the last formed toner image, viz. the black one, is ready to enter the station. Thus, the lastly formed toner image is the first to become transferred to a sheet. The firstly formed toner image, viz. the magenta one, takes with its leading edge a position on the belt as indicated by the cross 62 and will thus be transferred last. The other two toner images take positions with their leading edges as indicated by crosses 63 and 64, respectively.

Thus, the timing of exposure of the four distinct images, the relative position of these images on the photoconductive belt and the lengths of the path of this belt between the successive transfer stations are such that as a paper sheet follows a linear path through these stations, the partly simultaneous transfer of the distinct toner images to the paper sheet is such that a perfect registering of these images is obtained.

The sheet bearing a color toner image on its obverse side produced as described hereinbefore, is now passed through image forming station 21 for applying a color toner image to the reverse side of the sheet.

The buffer station 23 with an endless belt 24 transports the sheet bearing the color images to the fuser station 25. The buffer station 23 allows the speed of the sheet to change, thereby enabling the speed of fuser station 25 to be different from that of the speed of image forming stations 20, 21. In the apparatus according to the present embodiment, the speed of the two photoconductive belts may be, for example, 125 or 250 mm/s, whereas the fusing speed was 100 mm/s or less. The length of buffer station 23 is sufficient for receiving the largest sheet size to be processed in the apparatus. Buffer station 23 operates initially at the speed of the photoconductive belts of image forming stations 20 and 21. The speed of this station is reduced to the processing speed of fuser station 25 as the trailing edge of the sheet leaves the second image forming station 21.

The fuser station 25 operates to melt the toner particles transferred to the sheets in order to affix them. The fusing station 25 can be of known construction, and can be arranged for radiation or flash fusing, for fusing by convection and/or by pressure, etc. Hot fusing is preferred. The fused sheet is finally received on platform 14.

EXAMPLES

Example 1

In this example, reversal development is used. A photoconductive belt was charged to a dark potential of between 370 and 500 volts before being exposed image-wise to create a charge image thereon. The belt was moved at a speed of either 125 or 250 mm/sec past a development unit loaded with commercially available DCP-1 developer containing 4.2% toner (ex Xeikon NV). The development unit included a magnetic roller having a diameter of 20 mm, rotating at a circumferential speed which was twice that of the linear belt speed. The magnetic roller was spaced at a distance of 0.65±0.05 mm from the belt surface providing a development angle of between 6° and 8°. The magnetic pole strength of the development pole was 950±50 Gauss. Developer was supplied to the magnetic roller at between 65 and 80 mg/cm$^2$. The AC bias was 1500 volts (peak-to-peak). After development of the image on the belt, the toner image was transferred directly to a paper sheet substrate and the product was examined for background development. Results were classified as excellent (E), good (G), fair (F) and bad (B).

In the case of reversal development, the equation for Z can be re-written as follows:

$$Z = \frac{(V_0 - V_{DC})^2 \times f}{v_p^2} > 0.65$$

where $V_0$ is the dark potential in Volts, $V_{DC}$ is the DC bias potential, f is the AC bias frequency in kHz, and $v_p$ is the speed of the image forming belt in mm/s. The dark potential ($V_0$ volts), the DC bias potential ($V_{DC}$ volts) and the AC bias frequency (f kHz) were set as given in the following Table 1.

TABLE 1

| f (kHz) | $V_0$ (volts) | $V_{DC}$ (volts) | $V_p$ (mm/s) | Result | Z |
|---|---|---|---|---|---|
| 3 | 370 | 320 | 125 | B | 0.48 |
| 3 | 440 | 340 | 125 | G | 1.9 |
| 3 | 470 | 345 | 125 | E | 3.0 |
| 3 | 500 | 350 | 125 | E | 4.3 |
| 4 | 370 | 320 | 125 | F | 0.64 |
| 4 | 440 | 340 | 125 | E | 2.6 |
| 4 | 470 | 345 | 125 | E | 4.0 |
| 4 | 500 | 350 | 125 | E | 5.8 |
| 5 | 370 | 320 | 125 | G | 0.8 |
| 5 | 440 | 340 | 125 | G | 3.2 |
| 5 | 470 | 345 | 125 | E | 5.0 |
| 5 | 500 | 350 | 125 | E | 7.2 |
| 6 | 370 | 320 | 125 | G | 1.0 |
| 6 | 440 | 340 | 125 | E | 3.8 |
| 6 | 470 | 345 | 125 | E | 6.0 |
| 6 | 500 | 350 | 125 | E | 8.6 |
| 3 | 370 | 320 | 250 | B | 0.12 |
| 3 | 440 | 340 | 250 | B | 0.48 |
| 3 | 470 | 345 | 250 | G | 0.75 |
| 3 | 500 | 350 | 250 | E | 1.1 |
| 4 | 370 | 320 | 250 | B | 0.16 |
| 4 | 440 | 340 | 250 | F | 0.64 |
| 4 | 470 | 345 | 250 | E | 1.0 |
| 4 | 500 | 350 | 250 | E | 1.4 |
| 5 | 370 | 320 | 250 | B | 0.2 |
| 5 | 440 | 340 | 250 | G | 0.8 |
| 5 | 470 | 345 | 250 | E | 1.3 |
| 5 | 500 | 350 | 250 | E | 1.8 |
| 6 | 370 | 320 | 250 | B | 0.24 |
| 6 | 440 | 340 | 250 | G | 0.96 |
| 6 | 470 | 345 | 250 | E | 1.5 |
| 6 | 500 | 350 | 250 | E | 2.2 |

These results demonstrate that best results are obtained when the function Z exceeds 0.65, especially when the function Z exceeds 0.8.

Example 2

This was similar to Example 1, except that the developer used was AG940 (ex Agfa-Gevaert NV) containing 5% toner CB923. The results are set out in the following Table 2.

TABLE 2

| f (kHz) | $V_0$ (volts) | $V_{DC}$ (volts) | $V_p$ (mm/s) | Result | Z |
|---|---|---|---|---|---|
| 3 | 370 | 320 | 125 | B | 0.48 |
| 3 | 440 | 340 | 125 | G | 1.9 |
| 3 | 470 | 345 | 125 | E | 3.0 |
| 3 | 500 | 350 | 125 | E | 4.3 |
| 4 | 370 | 320 | 125 | F | 0.64 |
| 4 | 440 | 340 | 125 | E | 2.6 |
| 4 | 470 | 345 | 125 | E | 4.0 |
| 4 | 500 | 350 | 125 | E | 5.8 |
| 5 | 370 | 320 | 125 | E | 0.8 |
| 5 | 440 | 340 | 125 | E | 3.2 |
| 5 | 470 | 345 | 125 | E | 5.0 |
| 5 | 500 | 350 | 125 | E | 7.2 |
| 6 | 370 | 320 | 125 | E | 1.0 |
| 6 | 440 | 340 | 125 | E | 3.8 |
| 6 | 470 | 345 | 125 | E | 6.0 |
| 6 | 500 | 350 | 125 | E | 8.6 |
| 3 | 370 | 320 | 250 | B | 0.12 |
| 3 | 440 | 340 | 250 | B | 0.48 |
| 3 | 470 | 345 | 250 | G | 0.75 |
| 3 | 500 | 350 | 250 | G | 1.1 |
| 4 | 370 | 320 | 250 | B | 0.16 |
| 4 | 440 | 340 | 250 | F | 0.64 |

TABLE 2-continued

| f (kHz) | $V_0$ (volts) | $V_{DC}$ (volts) | $V_p$ (mm/s) | Result | Z |
|---|---|---|---|---|---|
| 4 | 470 | 345 | 250 | E | 1.0 |
| 4 | 500 | 350 | 250 | E | 1.4 |
| 5 | 370 | 320 | 250 | F | 0.2 |
| 5 | 440 | 340 | 250 | G | 0.8 |
| 5 | 470 | 345 | 250 | E | 1.3 |
| 5 | 500 | 350 | 250 | E | 1.8 |
| 6 | 370 | 320 | 250 | F | 0.24 |
| 6 | 440 | 340 | 250 | E | 0.96 |
| 6 | 470 | 345 | 250 | E | 1.5 |
| 6 | 500 | 350 | 250 | E | 2.2 |

These results demonstrate that best results are obtained when the function Z exceeds 0.65, especially when the function Z exceeds 0.8.

We claim:

1. A method of developing an electrostatic image formed on a moving image forming belt having a photoconductive surface and a back electrode, by charging the photoconductive surface to a dark potential $V_0$ (volts) to form a charged photoconductor surface, image-wise exposing said charged photoconductor surface to form an electrostatic image thereon, moving said image forming belt with a belt speed $v_p$ (mm/s) to bring said electrostatic image into the vicinity of a developing device in which a magnetic brush of developer material is established, applying a DC developing bias potential $V_{DC}$ between said magnetic brush and said back electrode, with a cleaning potential $V_{cl}$ (volts), and superimposing an AC voltage having an AC bias frequency f (kHz) over said DC developing bias potential, wherein said cleaning potential $V_{cl}$, said AC bias frequency f and said belt speed $v_p$ are such that:

$$\frac{V_{cl}^2 \times f}{v_p^2} > 0.65.$$

2. The method of claim 1, wherein said cleaning potential $V_{cl}$, said AC bias frequency f and said belt speed $v_p$ are such that:

$$\frac{V_{cl}^2 \times f}{v_p^2} > 0.8.$$

3. The method of claim 1, wherein said cleaning potential $V_{cl}$ lies between 20 and 250 volts.

4. The method of claim 1 wherein said AC bias frequency f lies between 1 and 8 kHz.

5. The method of claim 1 wherein said speed of said image forming belt $v_p$ lies between 50 and 500 mm/s.

6. The method of claim 1, wherein said electrostatic image is developed by reversal development and said dark potential $V_0$ lies between 200 and 800 volts.

* * * * *